United States Patent [19]

Tominaga et al.

[11] 4,395,980

[45] Aug. 2, 1983

[54] OVERHEAD CAM SHAFT TYPE V-ENGINE FOR VEHICLES

[75] Inventors: Nobuyoshi Tominaga, Hamamatsu; Nobuyoshi Kurai, Iwata; Hajime Ueno, Shizuoka; Sadahide Suzuki, Iwata, all of Japan

[73] Assignee: Yamaha Hatsudoki Kabushiki Kaisha, Iwata, Japan

[21] Appl. No.: 236,603

[22] Filed: Feb. 20, 1981

[30] Foreign Application Priority Data

Feb. 26, 1980 [JP] Japan ..... 55-22970

[51] Int. Cl.[3] ..... F01L 1/04

[52] U.S. Cl. ..... 123/90.27; 123/90.31; 123/195 AC

[58] Field of Search ..... 123/90.27, 90.31, 195 AC, 123/55 R

[56] References Cited

U.S. PATENT DOCUMENTS 3,738,338 6/1973 Wickman ..... 123/90.27

FOREIGN PATENT DOCUMENTS 55-5424 1/1980 Japan ..... 123/41.69

288025 4/1928 United Kingdom ..... 123/90.31

*Primary Examiner*—William A. Cuchlinski, Jr.

*Attorney, Agent, or Firm*—Donald D. Mon

[57] ABSTRACT

A motorcycle carries a multiple cylinder overhead cam shaft V-type engine whose cylinders are inclined in the plane of longitudinal (forward) movement of the vehicle. One cylinder (preferably the forward cylinder) is laterally offset to the right, and the other is laterally offset to the left. An overhead cam shaft is provided for each cylinder, and is driven by a drive located on the respective cylinder on the outside, in the direction of offset. An ignition plug and its cord are mounted on the opposite side, whereby to be shielded from obstacles by structure associated with the neighboring cylinder.

4 Claims, 5 Drawing Figures

OVERHEAD CAM SHAFT TYPE V-ENGINE FOR VEHICLES

FIELD OF THE INVENTION

The present invention relates to a vehicular overhead cam shaft type V-engine which has its respective cylinders inclined in the longitudinal direction, and which is arranged to protect vulnerable parts from damage.

BACKGROUND OF THE INVENTION

An engine of V-type, in which two cylinders are inclined in the longitudinal direction, has its front and rear cylinders offset in the transverse direction. In the V-engine, more specifically, in order that the enlarged end portions of the connecting rods of the paired front and rear cylinders may be hinged to a common crank pin, the cylinder, which has its larger connecting rod end portion hinged to the righthand side of the crank pin, is offset in the rightward direction, whereas the cylinder, which has its larger connecting rod end portion hinged to the lefthand side of the crank pin, is offset as a whole to the leftward direction. The V-engine thus constructed and equipped with the overhead cam shafts has to be equipped with an overhead cam shaft driving mechanism at either the right or left side of each cylinder. Therefore an ignition plug has to be arranged to protrude from the opposite side to the corresponding overhead cam shaft driving mechanism in order that it can be mounted and demounted. The ignition plug is connected with a plug chord, and, if this plug chord excessively protrudes sideways outwardly, it may make contact with an obstacle, when the driver walks his vehicle, whereby the plug chord or the ignition plug may be broken by the obstacle.

The present invention has been conceived in view of the background thus far described and contemplates to provide a vehiclular ovehead cam shaft type V-engine which has its ignition plugs and plug chords placed where they are protected from being struck by obstacles.

In order to attain the aforementioned contemplation, the present invention is constructed such that two cylinders are inclined in the longitudinal direction of a vehicle, and overhead cam shaft driving mechanisms are arranged in the rightward and leftward offset sides of the two cylinders, and ignition plugs are arranged to protrude obliquely from the opposite sides of the two cylinders to said offset sides so as to be sheltered by the adjacent cylinder. The present invention will now be described in detail with reference to the accompanying drawings.

BRIEF DESCRIPTION OF THE INVENTION

DETAILED DESCRIPTION OF THE INVENTION

Figure 1:
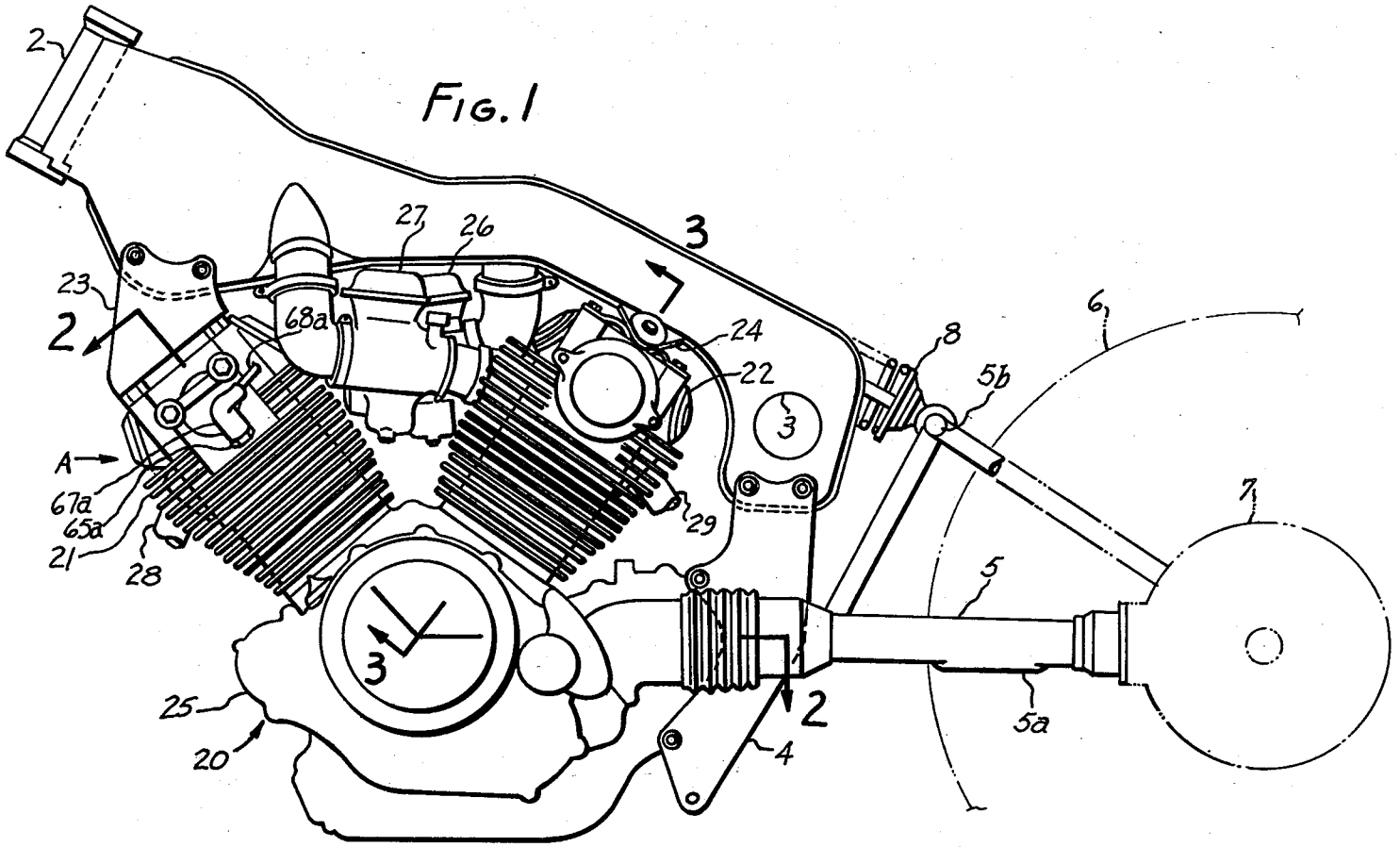
FIG. 1 is a side elevation showing a motorcycle, on which an engine according to the present invention is installed, with a portion being omitted.
Figure 4:
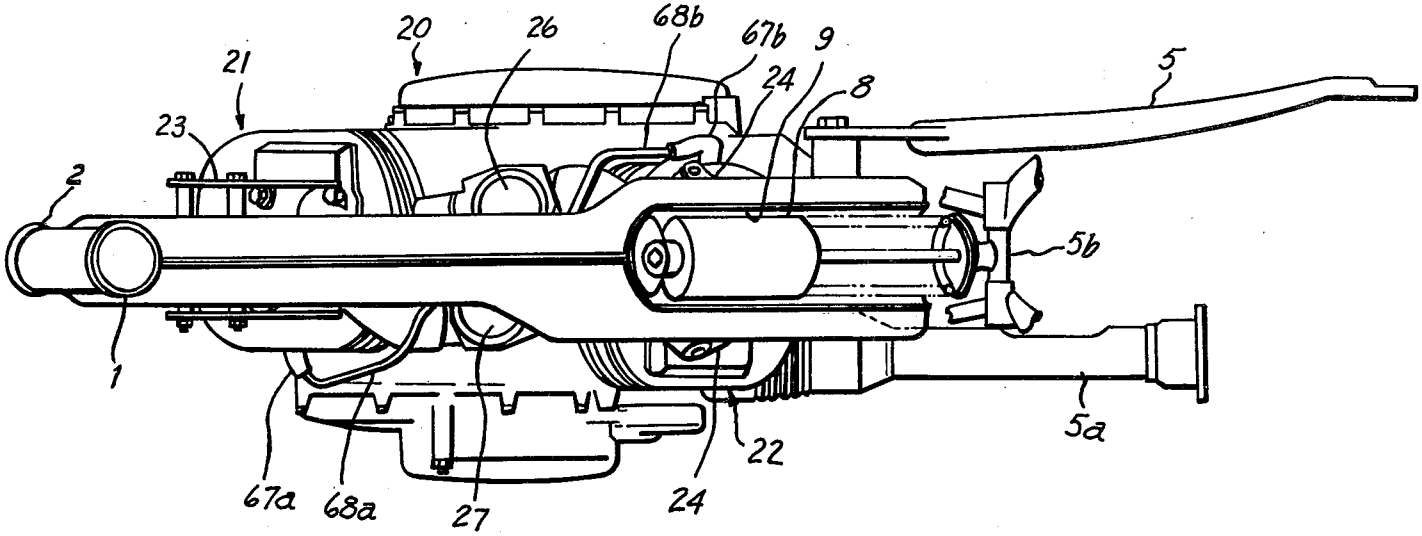
FIG. 4 is a top plan view showing the motorcycle with its portion being similarly omitted.

In these Figures, reference numeral 1 indicates a frame, which is constructed by welding a pair of frame members at their circumferential edges into a drum shape and which has its front end welded to a steering head pipe 2. To this steering head pipe 2, there is attached a front fork which is used to support a not-shown front wheel. The rear portion of the frame 1 is bent downward and formed with an opening 3. In this opening 3, there is mounted a not-shown air cleaner so that atmospheric air is introduced into the frame 1 through those air cleaner and opening 3. In other words, the inside of the frame 1 forms an intake passage through which intake air is introduced from the air cleaner into later-described carburetors 26 and 27. Indicated at numeral 4 are a pair of right and left brackets (only the left one of which is shown in FIG. 1) which are fixed to the rear end of the frame 1 and to which the rear end portion of a later-described engine 20 is fixed. Indicated at numeral 5 is a rear arm having a generally triangular shape, as viewed in a side elevation, which has its front end portion hinged to the aforementioned brackets 4 and its rear end portion supporting a rear wheel in a rotatable manner. Moreover, the lefthand bottom side 5*a* of that rear arm 5 is formed into a pipe shape while having its rear end connected to a rear hub case 7. In this hub case 7, there is mounted a reduction gear mechanism which is composed of a bevel gear, and a propeller shaft is received to extend through the bottom side 5*a* so that a well known shaft drive type rear wheel driving mechanism is constructed. To the vertex 5*b* of the rear arm 5, there is hinged the rear end of a cushion unit 8, which has its front end received axially in a recess 9 (as shown in FIG. 4) formed in the aforementioned frame 1.

Numeral 20 indicates an overhead cam shaft type V-type air-cooled two-cylinder engine which has its two cylinders 21 and 22 inclined in the longitudinal direction. In this engine 20, the upper portion of the front cylinder 21 and the upper portion of the rear cylinder 22 are attached to the afore-mentioned frame 1 through elastic members (not shown) by means of brackets 23 and 24, respectively. On the other hand, the engine 20 has its crank case 25 fixed at its rear end portion to the bracket 4, as has been described hereinbefore. The respective cylinder 21 and 22 have their facing sides formed with respective intake ports which are connected with the carburetors 26 and 27 positioned in the space defined between the respective cylinders 21 and 22. The carburetors 26 and 27 have their upstream sides further connected with the aforementioned frame 1. As a result, the intake air having entered the frame 1 from the aforementioned opening 3 are introduced through the frame 1 into the carburetors 26 and 27 of the respective cylinders 21 and 22. Numerals 28 and 29 indicate exhaust pipes which are connected to the front and rear sides of the respective cylinders 21 and 22.

Figure 2:
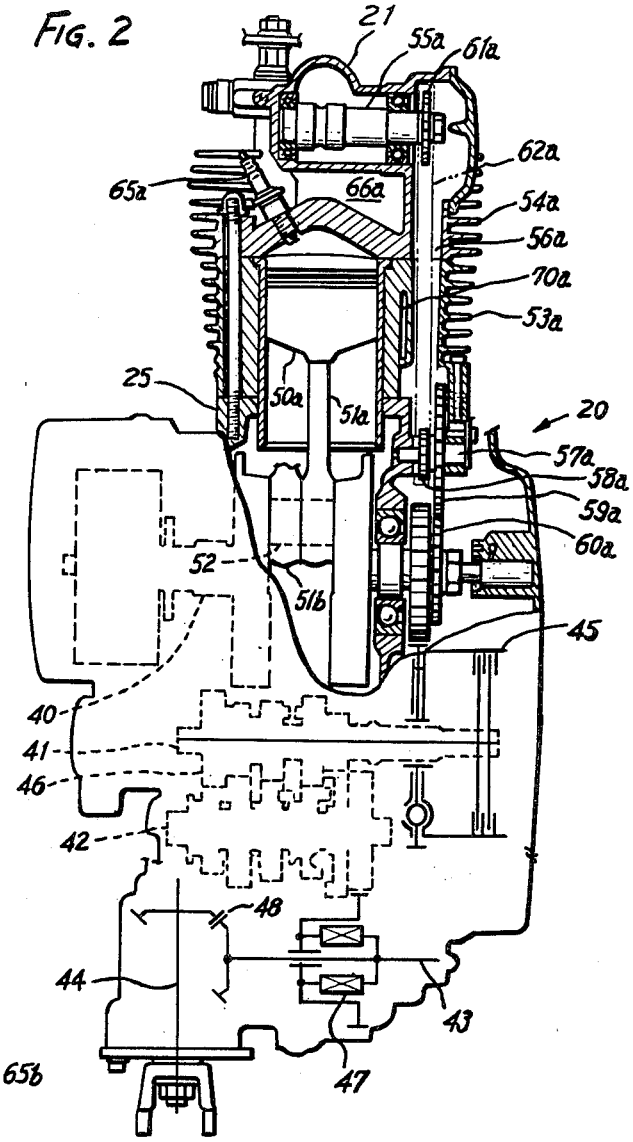
FIGS. 2 and 3 are sections taken along lines II—II and III—III of FIG. 1.

In FIG. 2, numerals 40, 41 and 42, 43 and 44 indicate a crankshaft, main and auxiliary shafts forming a part of the reduction gear mechanism, a damper shaft, and an output shaft, respectively. The rotations of the crankshaft 40 are transmitted through a well known wet type multiple disc clutch 45, which is attached to the right-hand end portion of the main shaft 41, to this shaft 41, the rotations of which in turn are transmitted to the auxiliary shaft 42 after having their speed changed by reduction gear train 46 which is mounted on the main shaft 41 and the auxiliary shaft 42. The rotations of the auxiliary shaft 42 are further transmitted through a damper 47, which is arranged on the damper shaft 43, to this shaft 43, the rotations of which in turn are transmitted through a bevel gear 48 to the output shaft 44 arranged to extend in the longitudinal direction. The output shaft 44 has its rear end portion protruding backwardly of the crankcase 25 such that its protrusion is connected to the aforementioned propeller shaft (although not shown) through a universal joint.

Numerals 50*a* and 51*a* indicate the piston and connecting rod of the front cylinder 21, whereas numerals 50*b* and 51*b* indicate the piston and connecting rod of the rear cylinder 22. As is apparent from FIGS. 2 and 3, the enlarged end portion of the connecting rod 51*a* of the front cylinder 21 and the enlarged end portion of the connecting rod 51*b* of the rear cylinder 22 are hinged together to a crank pin 52 such that the connecting rod 51*a* is positioned adjacent to the righthand side of the other connecting rod 51*b*. As a result, the front cylinder 21 is offset in the rightward direction whereas the rear cylinder 22 is offset in the leftward direction.

In FIG. 2, numerals 53*a* and 54*a* indicate the cylinder block and head of the front cylinder 21, and an overhead cam shaft 55*a* is transversely supported in the cylinder head 54*a* in a rotatable manner. The righthand side of the front cylinder 21, i.e., the offset side is formed with such a chain passage 56*a* as provide communication between the insides of the cylinder head 54*a* and the cylinder block 53*a*. Numeral 57*a* indicates a shaft which is attached to the crankcase 25 such that it is positioned between the aforementioned crankshaft 40 and overhead cam shaft 55*a*. On this shaft 57*a*, there is rotatably mounted a gear 59*a* which is made integral with a sprocket 58*a* and which is in meshing engagement with a gear 60*a* fixed to the crankshaft 40. The sprocket 58*a* is positioned in a lower portion of the aforementioned chain passage 56*a*. To the righthand end of the aforementioned overhead cam shaft 55, on the other hand, there is fixed a sprocket 61*a* which is disposed in an upper portion of the chain passage 56*a*. A timing chain 62*a* is made to run of those sprockets 58*a* and 61*a*. In other words, that timing chain 62*a* constitutes the overhead cam driving mechanism together with the gear 59*a* and the sprockets 58*a* and 61*a*. By this overhead cam shaft driving mechanism, incidentally, the overhead cam shaft 55*a* is rotated at a half speed of the crankshaft 40 thereby to control the openings of not-shown intake and exhaust valves.

Figure 5:
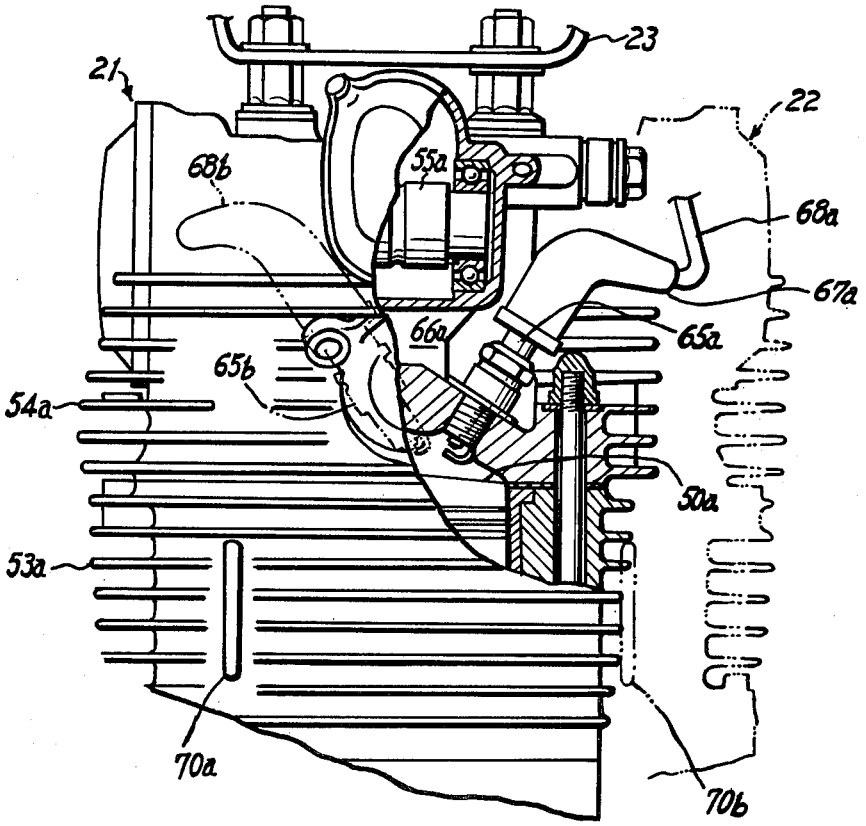
FIG. 5 is a view taken in the direction of arrow A from FIG. 1 for showing the relative positions of front and rear cylinders.

Numeral 65*a* indicates an ignition plug. Numeral 66*a* indicates a cooling air passage which is formed below the overhead cam shaft 55*a* and which is opened in the lefthand side of the front cylinder 21, i.e., the opposite side to the offset side of the same. The ignition plug 65*a* is attached to the lefthand side of the front cylinder 21 in a manner to protrude obliquely from the lefthand opening of that cooling air passage 66*a*. A plug chord 68*a* is connected with that ignition plug 65*a* by means of a plug cap 67*a* (as shown in FIGS. 1, 4 and 5).

Numeral 70*a* indicates an air communication passage which is formed in the cylinder block 53*a* such that it is interposed between the cylinder and the chain passage 56*a*, i.e., between the cylinder and the overhead cam shaft driving mechanism and is elongated to extend in the longitudinal direction.

Figure 3:
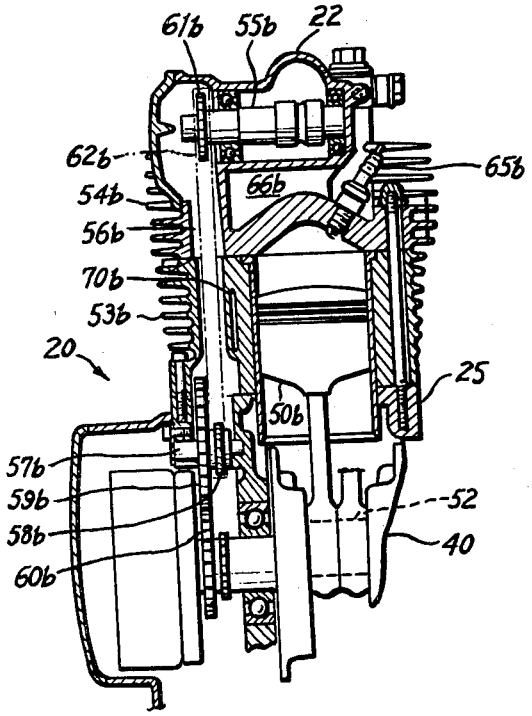

Since the rear cylinder 22 is constructed such that it is bisymmetric to the front cylinder 21, as shown in FIG. 3, its portions corresponding to those of the front cylinder 21 are indicated by adding a letter "b", for example, the overhead cam shaft of the rear cylinder 22 is indicated at 55*b*, so that their repeated explanations are omitted here.

The front cylinder 21 is not only offset rightwardly, as has been described hereinbefore, but also is equipped with the timing chain 62*a* at its righthand side. On the other hand, the rear cylinder 22 is not only offset leftwardly but also equipped with a timing chain 62*b* at its lefthand side. As a result, the rear cylinder 22 has its ignition plug 65*b* and plug cap 68*b* hidden behind the front cylinder 21, as is apparent from FIG. 5. Likewise, the ignition plug and cap 65*a* and 68*a* of the front cylinder 21 are also positioned inside of the lefthand side of the rear cylinder 22. As a result, even if there exists an obstacle when the vehicle is to be moved forward by the driver, that obstacle will hit the righthand side of the front cylinder 21 before the ignition plug or the like of the rear cylinder 22 so that the ignition plug 65*b*, the plug cap 67*b* and the plug chord 68*b* of the rear cylinder 22 can be effectively protected. On the other hand, since the front cylinder 21 is offset rightwardly, the position of the ignition plug 65*a* of the front cylinder 21 approaches the side of the frame 1 (or toward the center of the vehicular body), as is apparent from FIG. 4, so that the leftward protrusions of the ignition plug 65*a*, the plug cap 67*a* and plug chord 68*a* from the frame 1 are accordingly reduced. As a result, the ignition plug 65*a*, the plug cap 67*a* and the plug chord 68*a* of the front cylinder are reluctant to be hit by the obstacle.

Moreover, since the front cylinder 21 is formed with the air communication passage 70*a*, the coming air flow passes through that communication passage 70*a* until it is introduced to the ignition plug 65*b* of the rear cylinder 22. As a result, the cooling characteristics of the rear cylinder 22 can be improved.

According to the embodiment, still moreover, since the rear cylinder 22 is also formed with an air communication passage 70*b*, the coming air flow also hits the surroundings of the exhaust pipe 29 of the rear cylinder 22 so that the cooling characteristics can be further improved.

In the embodiment, incidentally, although the overhead cam shaft driving mechanism is constructed of the timing chain, it may be constructed of the toothed belt, a bevel gear or a train of a plurality of spur gears.

As has been described hereinbefore, according to the present invention, since the overhead cam shaft driving mechanisms are arranged at the offset sides of the front and rear cylinders and since the ignition plugs are arranged to protrude obliquely from the opposite sides of the respective cylinders to those offset sides, each of the ignition plugs is not only retracted to the vehicular body from the cylinder having the other ignition plug but also positioned closer to the center of the vehicular body. As a result, the ignition plugs, the plug chords and so on become reluctant to be attacked by an obstacle so that they can be prevented from being broken.

We claim:

1. In combination with a wheeled vehicle having a forward direction of motion, an overhead cam-shaft V-type engine comprising a front and a rear cylinder, said cylinders being inclined to the vertical and parallel to a vertical plane which includes the said direction, when the vehicle is upright, said cylinders being laterally offset relative to said direction, oppositely from one another; an overhead cam shaft on each cylinder; cam shaft drive means disposed along each respective cylinder on the outside thereof in the direction of the respective offset; an ignition plug and cord respective to each cylinder mounted thereto on the opposite side thereof, whereby structure associated with each cylinder projects laterally beyond the ignition plug of the other cylinder and thereby protects it from striking obstacles.

2. A combination according to claim 1 in which said vehicle includes a frame which at least partially shields the front ignition plug.

3. A combination according to claim 1 in which the vehicle is a motorcycle, and the front cylinder is offset to the right, whereby when a motorcyclist on the left walks his cycle forwardly, the rear plug is protected by the structure associated with the forward cylinder, and the forward plug is inherently protected because of the side clearance the motorcyclist will provide for himself.

4. A combination according to claim 1 in which a cooling passage is formed beneath said cam shaft and in communication with said plug on the side of the front cylinder opposite from said cam shaft drive means.

* * * * *